US006517324B2

(12) United States Patent
Ota et al.

(10) Patent No.: US 6,517,324 B2
(45) Date of Patent: Feb. 11, 2003

(54) CONTROL VALVE FOR VARIABLE DISPLACEMENT TYPE COMPRESSOR

(75) Inventors: Masaki Ota, Kariya (JP); Ken Suitou, Kariya (JP); Kazuya Kimura, Kariya (JP); Tatsuya Hirose, Kariya (JP); Satoshi Umemura, Kariya (JP); Yuji Hashimoto, Kariya (JP); Masami Niwa, Kariya (JP); Kazuhiko Minami, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 09/948,356

(22) Filed: Sep. 7, 2001

(65) Prior Publication Data

US 2002/0064467 A1 May 30, 2002

(30) Foreign Application Priority Data

Sep. 8, 2000 (JP) ..... 2000-273824
May 25, 2001 (JP) ..... 2001-156764

(51) Int. Cl.[7] ..... F04B 1/26
(52) U.S. Cl. ..... 417/222.2; 62/228.5
(58) Field of Search ..... 417/222.2; 62/228.5, 62/228.3

(56) References Cited

U.S. PATENT DOCUMENTS 5,205,718 A 4/1993 Fujisawa et al. ..... 417/222.2
6,164,925 A 12/2000 Yokomachi et al. ..... 417/222.2
6,336,335 B2 * 1/2002 Ota et al. ..... 123/198 R
6,371,734 B1 * 4/2002 Ota et al. ..... 417/222.2
6,382,926 B2 * 5/2002 Ota et al. ..... 417/222.2
6,385,979 B2 * 5/2002 Ota et al. ..... 62/115
6,386,834 B1 * 5/2002 Kimura et al. ..... 417/222.2
2001/0002237 A1 * 5/2001 Ota et al. ..... 417/222.2
2001/0008131 A1 * 7/2001 Ota et al. ..... 123/339.17
2001/0013225 A1 * 8/2001 Ota et al. ..... 62/228.5
2001/0014287 A1 * 8/2001 Ota et al. ..... 417/213
2001/0027658 A1 * 10/2001 Ota et al. ..... 62/228.3
2001/0027659 A1 * 10/2001 Ota et al. ..... 62/228.3
2001/0052236 A1 * 12/2001 Ota et al. ..... 62/228.3
2001/0055531 A1 * 12/2001 Ota et al. ..... 417/222.2
2002/0011074 A1 * 1/2002 Suitou et al. ..... 62/228.3
2002/0031432 A1 * 3/2002 Ota et al. ..... 417/222.2
2002/0035842 A1 * 3/2002 Suitou et al. ..... 62/228.3
2002/0037223 A1 * 3/2002 Suitou et al. ..... 417/222.2
2002/0064467 A1 * 5/2002 Ota et al.

FOREIGN PATENT DOCUMENTS

JP 4-35072 12/1992 ..... F04B/49/00
JP 5-133326 5/1993 ..... F04B/27/08
JP 11-324930 11/1999 ..... F04B/49/00
JP 2000-9044 1/2000 ..... F04B/49/06

* cited by examiner

*Primary Examiner*—Charles G. Freay
*Assistant Examiner*—William H. Rodriguez
(74) *Attorney, Agent, or Firm*—Morgan & Finnegan, LLP

(57) ABSTRACT

A control valve is used for a variable displacement compressor. The compressor has a crank chamber and a supply passage. The control valve includes a valve housing. A valve chamber is defined in the valve housing. A valve body is accommodated in the valve chamber for adjusting the opening size of the supply passage. A pressure sensing chamber is defined in the valve housing. A pressure sensing member separates the pressure sensing chamber into a first pressure chamber and a second pressure chamber. The pressure at a first pressure monitoring point is applied to the first pressure chamber. The pressure at a second pressure monitoring point located is applied to the second pressure chamber. The pressure sensing member moves the valve body in accordance with the pressure difference between the first pressure chamber and the second pressure chamber. The pressure sensing member is a bellows or a diaphragm, an actuator applies force to the pressure sensing member in accordance with external commands. The force is applied by the actuator corresponds to a target value of the pressure difference. The pressure sensing member moves the valve body such that the pressure difference seeks the target value.

6 Claims, 9 Drawing Sheets

CONTROL VALVE FOR VARIABLE DISPLACEMENT TYPE COMPRESSOR

BACKGROUND OF THE INVENTION

The present invention relates to a control valve used for a displacement variable compressor incorporated in a refrigerant circuit of an air-conditioning system for controlling the discharge displacement of the variable displacement type compressor, which can change the discharge displacement in accordance with the pressure in the crank chamber.

As shown in FIG. 10, Japanese Unexamined Patent Publication 11-324930 discloses such a control valve. This control valve mechanically detects the pressure difference between two pressure monitoring points P1 and P2, which are located in a refrigerant circuit, by a diaphragm 101. The control valve adjusts the pressure in a crank chamber by determining the position of a valve body 102 in accordance with a force that acts on the diaphragm 101 based on the pressure difference. The pressure difference reflects the flow rate of refrigerant in the refrigerant circuit. The diaphragm 101 changes the discharge displacement of the variable displacement compressor by determining the position of the valve body 102 such that the fluctuations of the pressure difference, that is, the fluctuations of the flow rate of refrigerant in the refrigerant circuit is eliminated.

The prior art control valve only has a simple internal control structure that maintains a predetermined flow rate of refrigerant. Therefore, the prior art control valve is not capable of changing the flow rate of refrigerant in the refrigerant circuit. Thus, the control valve cannot respond to the changes in the demand for air conditioning.

SUMMARY OF THE INVENTION

The objective of the present invention is to provide a control valve of a variable displacement compressor that is capable of highly accurate air-conditioning control.

To achieve the foregoing objective, the present invention also provides a control valve used for a variable displacement compressor installed in a refrigerant circuit of a vehicle air conditioner. The refrigerant circuit has a discharge pressure zone. The compressor varies the displacement in accordance with the pressure in a crank chamber. The compressor has a supply passage, which connects the crank chamber to the discharge pressure zone. The control valve comprises a valve housing. A valve chamber is defined in the valve housing to form a part of the supply passage. A valve body is accommodated in the valve chamber for adjusting the opening size of the supply passage. A pressure sensing chamber is defined in the valve housing. A pressure sensing member separates the pressure sensing chamber into a first pressure chamber and a second pressure chamber. The pressure at a first pressure monitoring point located in the refrigerant circuit is applied to the first pressure chamber. The pressure at a second pressure monitoring point located in the refrigerant circuit is applied to the second pressure chamber. The pressure sensing member moves the valve body in accordance with the pressure difference between the first pressure chamber and the second pressure chamber such that the displacement of the compressor is varied to counter changes of the pressure difference. The pressure sensing member is a bellows or a diaphragm. An actuator applies force to the pressure sensing member in accordance with external commands. The force applied by the actuator corresponds to a target value of the pressure difference. The pressure sensing member moves the valve body such that the pressure difference seeks the target value.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A control valve CV of a swash plate type variable displacement compressor that is provided in a vehicle air-conditioning system according to a first embodiment of the present invention will now be described with reference to FIGS. 1 and 2.

Figure 1:
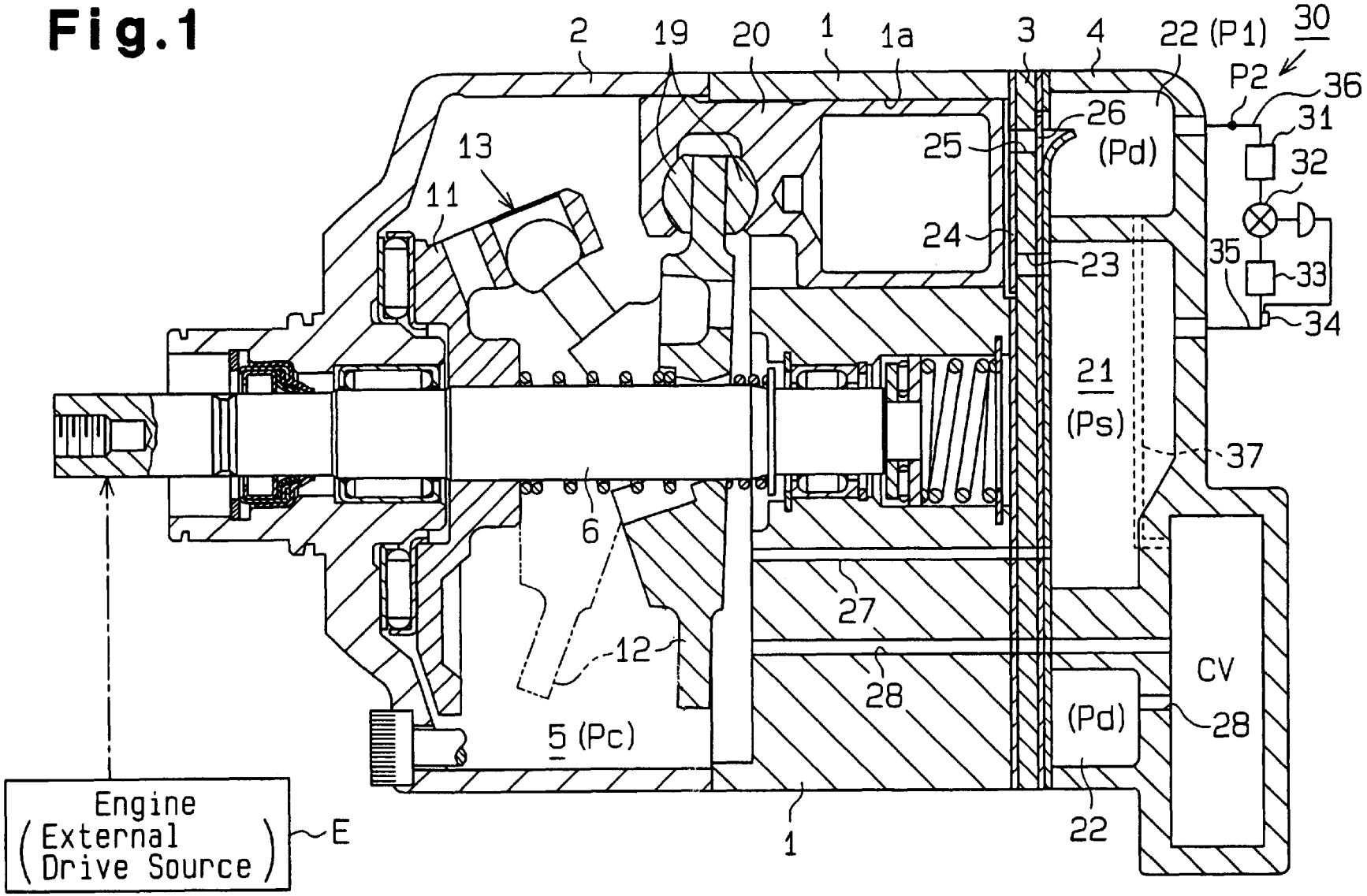
FIG. 1 is a cross-sectional view of a swash plate type variable displacement compressor according to a first embodiment.

The compressor shown in FIG. 1 includes a cylinder block 1, a front housing member 2 connected to the front end of the cylinder block 1, and a rear housing member 4 connected to the rear end of the cylinder block 1. A valve plate 3 is located between the rear housing member 4 and the cylinder block 1. The front housing member 2, the cylinder block 1 and the rear housing member 4 form a housing of the compressor.

A crank chamber 5 is defined between the cylinder block 1 and the front housing member 2. A drive shaft 6 is supported in the crank chamber 5. The drive shaft 6 is connected to an engine E of the vehicle. A lug plate 11 is fixed to the drive shaft 6 in the crank chamber 5 to rotate integrally with the drive shaft 6.

A drive plate, which is a swash plate 12 in this embodiment, is accommodated in the crank chamber 5. The swash plate 12 slides along the drive shaft 6 and inclines with respect to the axis of the drive shaft 6. A hinge mechanism 13 is provided between the lug plate 11 and the swash plate 12. The swash plate 12 is coupled to the lug plate 11 and the drive shaft 6 through the hinge mechanism 13. The swash plate 12 rotates synchronously with the lug plate 11 and the drive shaft 6.

Formed in the cylinder block 1 are cylinder bores 1*a* (only one is shown in FIG. 1) at constant angular intervals around the drive shaft 6. Each cylinder bore 1*a* accommodates a single headed piston 20 such that the piston can reciprocate in the bore 1*a*. In each bore 1*a* is a compression chamber, the displacement of which varies in accordance with the reciprocation of the piston 20. The front end of each piston 20 is connected to the periphery of the swash plate 12 through a pair of shoes 19. As a result, the rotation of the swash plate 12 is converted into reciprocation of the pistons 20, and the strokes of the pistons 20 depend on the inclination angle of the swash plate 12.

The valve plate 3 and the rear housing member 4 define, between them, a suction chamber 21 and a discharge chamber 22, which surrounds the suction chamber 21. The valve plate 3 forms, for each cylinder bore 1*a,* a suction port 23, a suction valve 24 for opening and closing the suction port 23, a discharge port 25, and a discharge valve 26 for opening and closing the discharge port 25. The suction chamber 21 communicates with each cylinder bore 1*a* through the corresponding suction port 23, and each cylinder bore 1*a* communicates with the discharge chamber 22 through the corresponding discharge port 25.

When the piston 20 in a cylinder bore 1*a* moves from its top dead center position to its bottom dead center position, the refrigerant gas in the suction chamber 21 flows into the cylinder bore 1*a* through the corresponding suction port 23 and the corresponding suction valve 24. When the piston 20 moves from its bottom dead center position toward its top dead center position, the refrigerant gas in the cylinder bore 1*a* is compressed to a predetermined pressure, and it forces the corresponding discharge valve 26 to open. The refrigerant gas is then discharged through the corresponding discharge port 25 and the corresponding discharge valve 26 into the discharge chamber 22.

Figure 2:
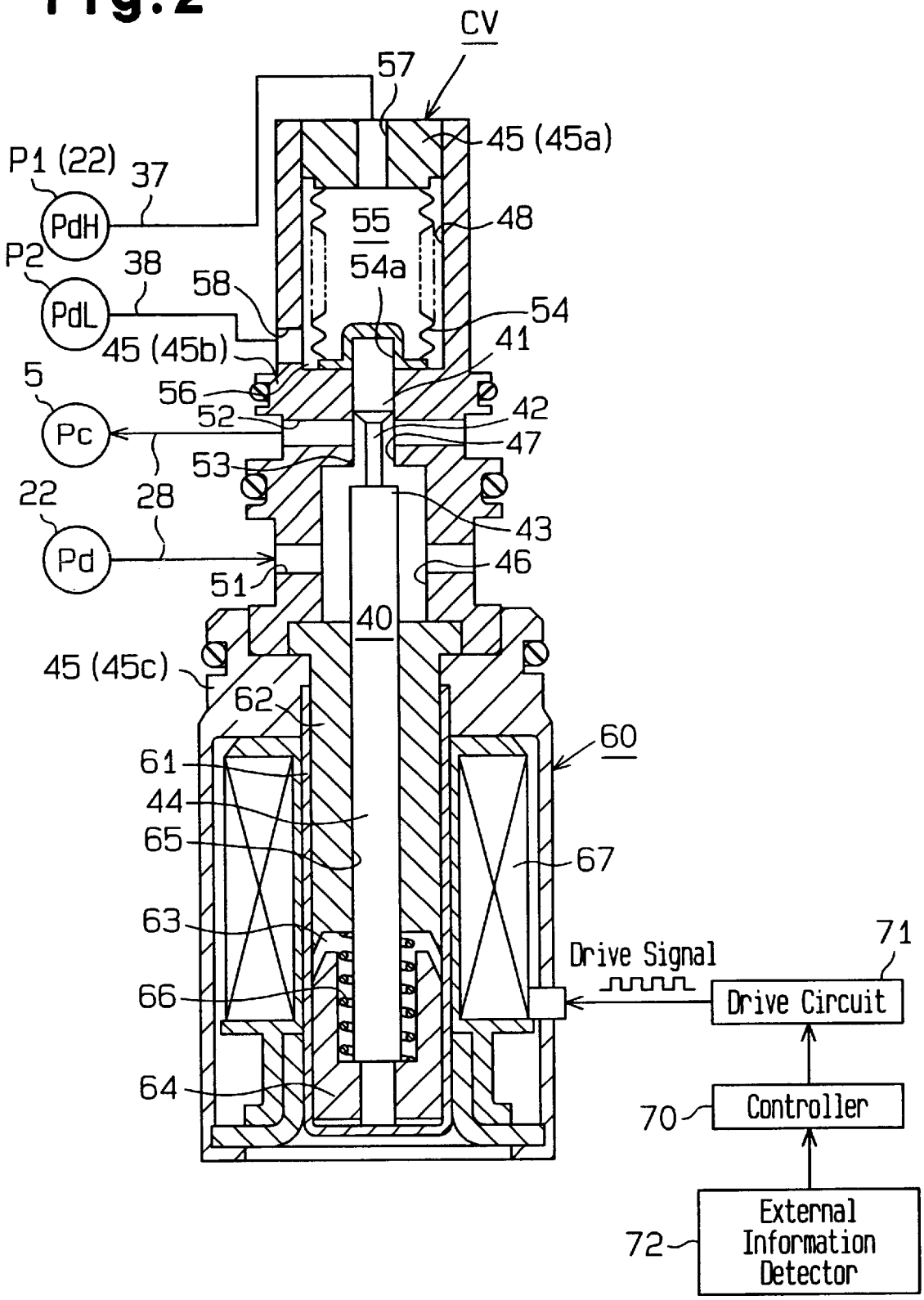
FIG. 2 is a cross-sectional view of the control valve provided in the compressor of FIG. 1.

A mechanism for controlling the pressure of the crank chamber 5 (a crank pressure Pc) includes a bleed passage 27, a supply passage 28 and the control valve CV as shown in FIGS. 1 and 2. The passages 27, 28 are formed in the housing. The bleed passage 27 connects the suction chamber 21 as a suction pressure zone with the crank chamber 5. The control valve CV is located in the bleed passage 27.

The control valve CV changes the opening size of the bleed passage 27 to adjust the flow rate of refrigerant gas from the crank chamber 5 to the suction chamber 21. The crank pressure Pc is changed in accordance with the relationship between the flow rate of refrigerant gas from the discharge chamber 22 to the crank chamber 5 and the flow rate of refrigerant gas flowing out from the crank chamber 5 to the suction chamber 21 through the bleed passage 27. The difference between the crank pressure Pc and the pressure in the cylinder bores 1*a* is changed in accordance with the crank pressure Pc, which varies the inclination angle of the swash plate 12. This alters the stroke of each piston 20 and the compressor displacement.

FIG. 1 illustrates a refrigerant circuit of the vehicle air-conditioning system. The refrigerant circuit has a swash plate type variable displacement compressor and an external refrigerant circuit 30. The external refrigerant circuit 30 includes, for example, a condenser 31, an expansion valve 32 and an evaporator 33. The opening of the expansion valve 32 is feedback-controlled based on the temperature detected by a heat sensitive tube 34 at the outlet of the evaporator 33. The expansion valve 32 supplies refrigerant, the amount of which corresponds to the thermal load to the evaporator 33 to regulate the flow rate.

A first connecting pipe 35, which connects the outlet of the evaporator 33 and the suction chamber 21 of the compressor, is located downstream of the external refrigerant circuit 30. A second connecting pipe 36, which connects the discharge chamber 22 of the compressor and the inlet of the condenser 31, is located upstream of the external refrigerant circuit 30.

The greater the flow rate of refrigerant in the refrigerant circuit is, the greater the pressure loss per unit length of the circuit or the pipe is. That is, the pressure loss between two pressure monitoring points in the refrigerant circuit corresponds to the flow rate of refrigerant in the circuit. Detecting the pressure difference between two pressure monitoring points P1, P2 (hereinafter referred to as the pressure difference ΔPd) permits the flow rate of refrigerant in the circuit to be indirectly detected.

In the first embodiment, a first pressure monitoring point P1 is located in the discharge chamber 22. A second pressure monitoring point P2 is located in the second connecting pipe 36 and is separated from the first pressure monitoring point P1 by a predetermined distance. As shown in FIG. 2, a monitored pressure PdH of refrigerant at the first pressure monitoring point P1 is applied to the control valve CV through a first pressure detecting passage 37. The monitored pressure PdL at the second pressure monitoring point P2 is applied to the control valve CV through a second pressure detecting passage 38.

As shown in FIG. 2, the control valve CV includes a supply side valve portion and a solenoid portion 60. The supply side valve portion controls the opening size of the supply passage 28 connecting the discharge chamber 22 with the crank chamber 5. The solenoid portion 60 serves as an electromagnetic actuator for controlling an operation rod 40 provided in the control valve CV based on the level of an externally supplied current. The operation rod 40 has a distal end 41, a connecting portion 42, a valve body portion 43, and a guide portion 44. The valve body portion 43 is part of the guide portion 44.

A valve housing 45 of the control valve CV includes a cap 45*a,* an upper-half body 45*b,* and a lower-half body 45*c.* A valve chamber 46 and a communication passage 47 are defined in the upper-half body 45*b.* A pressure sensing chamber 48 is defined between the upper-half body 45*b* and the cap 45*a.*

The operation rod 40 is located in the valve chamber 46 and the communication passage 47 such that the operation rod 40 moves in the axial direction of the control valve CV (vertical direction in FIG. 2). The valve chamber 46 communicates with the communication passage 47 selectively in accordance with the position of the operation rod 40. The communication passage 47 is isolated from the pressure sensing chamber 48 by the distal end 41 of the operation rod 40.

The upper end face of a fixed iron core 62 serves as the bottom wall of the valve chamber 46. A port 51, which extends radially from the valve chamber 46, connects the valve chamber 46 with the suction chamber 21 through a downstream part of the bleed passage 27. A port 52 extending radially from the communication passage 47 connects the communication passage 47 with the crank chamber 5 through an upstream part of the bleed passage 27. Thus, the port 51, the valve chamber 46, the communication passage 47, and the port 52 serve as part of the bleed passage 27, which connects the discharge chamber 22 with the crank chamber 5 and serves as the control passage.

The valve body portion 43 of the operation rod 40 is located in the valve chamber 46. A step between the valve chamber 46 and the communication passage 47 functions as a valve seat 53. When the operation rod 40 moves from the position shown in FIG. 2 (the lowest position) to the highest position, where the valve body portion 43 of the operation rod 40 contacts the valve seat 53, the communication passage 47 is closed. The valve body portion 43 of the operation rod 40 functions as a supply side valve body, which selectively adjusts the opening size of the supply passage 28.

A tubular pressure sensing member 54, which has a closed end, is accommodated in the pressure sensing chamber 48. The pressure sensing member 54 is a bellows in this embodiment. The pressure sensing member 54 is made of metal material such as copper. The upper end portion of the pressure sensing member 54 is secured to the cap 45*a* of the valve housing 45 by, for example, welding. The pressure sensing member 54 defines a first pressure chamber 55 and a second pressure chamber 56 in the pressure sensing chamber 48.

An accommodating portion 54*a* is formed at the bottom wall portion of the pressure sensing member 54. The distal end 41 of the operation rod 40 is inserted in the accommodating portion 54*a*. The pressure sensing member 54 is elastically deformed during its installation. The pressure sensing member 54 is pressed against the distal end 41 of the operation rod 40 through the accommodating portion 54*a* by a force based on the elasticity of the pressure sensing member 54. The amount of initial elastic deformation of the pressure sensing member 54 with respect to the valve housing 45 during the installation can be changed according to the degree of press fitting of the cap 45*a* in the upper-half body 45*b*.

The first pressure chamber 55 is connected to the discharge chamber 22, in which the first pressure monitoring point P1 is located, through a first port 57 formed in the cap 45*a* and the first pressure detecting passage 37. The second pressure chamber 56 is connected to the second pressure monitoring point P2 through a second port 58, which extends through the upper-half body 45*b*, and the second pressure detecting passage 38. The pressure PdH of the first pressure monitoring point P1 is applied to the first pressure chamber 55. The pressure PdL of the second pressure monitoring point P2 is applied to the second pressure chamber 56.

The solenoid portion 60 includes an accommodating cylinder 61 having a closed end. A fixed iron core 62 is fitted in the accommodating cylinder 61. A solenoid chamber 63 is defined in the accommodating cylinder 61. A movable iron core 64 is located in the solenoid chamber 63 to be movable in the axial direction. A guide hole 65, which extends in the axial direction, is formed at the center of the fixed iron core 62. The guide portion 44 of the operation rod 40 is located in the guide hole 65 to be movable in the axial direction. The bottom end of the guide portion 44 is secured to the movable iron core 64 in the solenoid chamber 63. Therefore, the movable iron core 64 and the operation rod 40 move vertically as a unit.

A return spring 66, which is formed of a coil spring, is accommodated between the fixed iron core 62 and the movable iron core 64 in the solenoid chamber 63. The return spring 66 urges the operation rod 40 downward in FIG. 2 such that the movable iron core 64 is separated from the fixed iron core 62.

The valve chamber 46 and the solenoid chamber 63 are connected through the clearance between the guide portion 44 of the operation rod 40 and the guide hole 65. Therefore, the pressure of the valve chamber 46, that is, the discharge pressure Pd (PdH) is applied to the solenoid chamber 63. Thus, the solenoid chamber 63, in which the movable iron core 64 moves, receives the discharge pressure Pd through the clearance between the inner wall of the solenoid chamber 63 and the movable iron core 64.

According to the control valve CV of the first embodiment, in which the pressure sensing member 54 senses the pressure difference between the two points P1, P2 in the discharge pressure zone, the position of the operation rod 40, that is, the opening size of the control valve CV, is accurately adjusted by applying the discharge pressure Pd to the solenoid chamber 63. The discharge pressure Pd that is applied to the solenoid chamber 63 is not limited to PdH. For example, the discharge pressure PdL, which is lower than PdH, may be applied to the solenoid chamber 63 from the second pressure chamber 56.

A coil 67 is wound around the fixed iron core 62 and the movable iron core 64. A drive signal is supplied to the coil 67 from a drive circuit 71. The drive signal is supplied based on a command from a controller 70 in accordance with the external information from the external information detector 72. The external information includes the temperature of the passenger compartment of the vehicle and a target temperature. The coil 67 generates the electromagnetic force between the movable iron core 64 and the fixed iron core 62 corresponding to the level of supplied current. The current value that is supplied to the coil 67 is controlled by adjusting the applied voltage to the coil 67. The duty control is used for adjusting the applied voltage in this embodiment.

The opening size of the control valve CV of the first embodiment is determined by the position of the operation rod 40.

When no current is supplied to the coil 67, or when duty ratio is zero percent, the downward force of the pressure sensing member 54 and the return spring 66 position the rod 40 at the lowest position shown in FIG. 2. Thus, the valve body portion 43 opens the communication passage 47. Therefore, the crank pressure Pc is the maximum, which increases the difference between the crank pressure Pc and the pressure in the cylinder bore 1*a*. Accordingly, the inclination angle of the swash plate 12 is the minimum, which minimizes the discharge displacement of the compressor.

When a current having the minimum duty ratio or more is supplied to the coil 67 (the minimum duty ratio is greater than zero percent), the upward electromagnetic force exceeds the downward force of the pressure sensing member 54 and the return spring 66. Thus, the operation rod 40 moves upward. The upward electromagnetic force, which is directed oppositely to the downward force of the return spring 66, counters the downward force of the pressure difference $\Delta Pd$. In this case, the downward force of the pressure difference acts in the same direction as the downward force of the pressure sensing member 54. The valve body portion 43 of the operation rod 40 is positioned with respect to the valve seat 53 such that the upward force and the downward force are balanced.

When the rotational speed of the engine E decreases, which decreases the discharge displacement of the compressor, the discharge pressure Pd drops, which causes the downward force based on the pressure difference $\Delta P$ to decrease. Accordingly, the forces applied to the operation rod 40 are not balanced. Therefore, the operation rod 40 moves upward, thus compressing the pressure sensing member 54 and the return spring 66. The valve body portion 43 of the operation rod 40 is positioned such that the resulting increase in the downward forces of the pressure sensing member 54 and the spring 66 compensates for the reduction in the downward force based on the lower pressure difference ΔPd. As a result, the opening size of the communication passage 47 decreases, which decreases the crank pressure Pc. Accordingly, the difference between the crank pressure Pc and the pressure in each cylinder bore 1*a* decreases. Thus, the inclination angle of the swash plate 12 increases, which increases the discharge displacement of the compressor. When the discharge displacement of the compressor increases, the discharge pressure Pd increases, which increases the pressure difference ΔPd.

On the other hand, when the rotational speed of the engine E increases, which increases the discharge displacement of the compressor, the discharge pressure Pd increases, which increases the downward force based on the pressure difference ΔP. Accordingly, the forces applied to the operation rod 40 are not balanced. Therefore, the operation rod 40 moves downward, and the pressure sensing member 54 and the return spring 66 expand. The valve body portion 43 of the operation rod 40 is positioned such that the resulting decrease in the downward forces of the pressure sensing member 54 and the return spring 66 compensates for the increase in the downward force based on the greater pressure difference ΔPd. As a result, the opening size of the communication passage 47 increases, which increases the crank pressure Pc. Accordingly, the difference between the crank pressure Pc and the pressure in each cylinder bore 1*a* increases. Thus, the inclination angle of the swash plate 12 decreases, which decreases the discharge displacement of the compressor. When the discharge displacement of the compressor decreases, the discharge pressure Pd decreases, which decreases the pressure difference ΔPd.

When the duty ratio of the current that is supplied to the coil 67 increases, which increases the electromagnetic force, balance of the various forces is not achieved by the pressure difference ΔPd. Therefore, the operation rod 40 moves upward so that the pressure sensing member 54 and the return spring 66 are compressed. The valve body portion 43 is positioned such that the resulting increase in the downward forces of the pressure sensing member 54 and the spring 66 compensates for the increase in the upward electromagnetic force. Therefore, the opening size of the control valve CV, that is, the opening size of the communication passage 47, is decreased, which increases the discharge displacement of the compressor. As a result, the discharge pressure Pd increases, which also increases the pressure difference ΔPd.

When the duty ratio of the current that is supplied to the coil 67 decreases, which decreases the electromagnetic force, balance of the various forces is not achieved by the pressure difference ΔPd. Therefore, the operation rod 40 moves downward, and the pressure sensing member 54 and the return spring 66 expand. The valve body portion 43 is positioned such that the decrease in the downward force of the pressure sensing member 54 and the spring 66 compensates for the decrease in the upward electromagnetic force. Therefore, the opening size of the valve hole 49 is decreased, which decreases the discharge displacement of the compressor. As a result, the discharge pressure Pd decreases, which also decreases the pressure difference ΔPd.

As described above, the control valve CV of this embodiment positions the operation rod 40 according to the fluctuations of the pressure difference ΔPd. The control valve CV maintains the target value of the pressure difference ΔPd, which is determined by the duty ratio of the current that is supplied to the coil 67. The target value of the pressure difference ΔPd is changed by adjusting the duty ratio of the current that is supplied to the coil 67. The pressure difference ΔPd fluctuates if the crank pressure Pc varies even when the discharge pressure Pd is constant. However, the crank pressure Pc is far smaller than the discharge pressure Pd. Thus, the crank pressure Pc is deemed to be substantially constant.

The first embodiment provides the following advantages.

Figure 7:
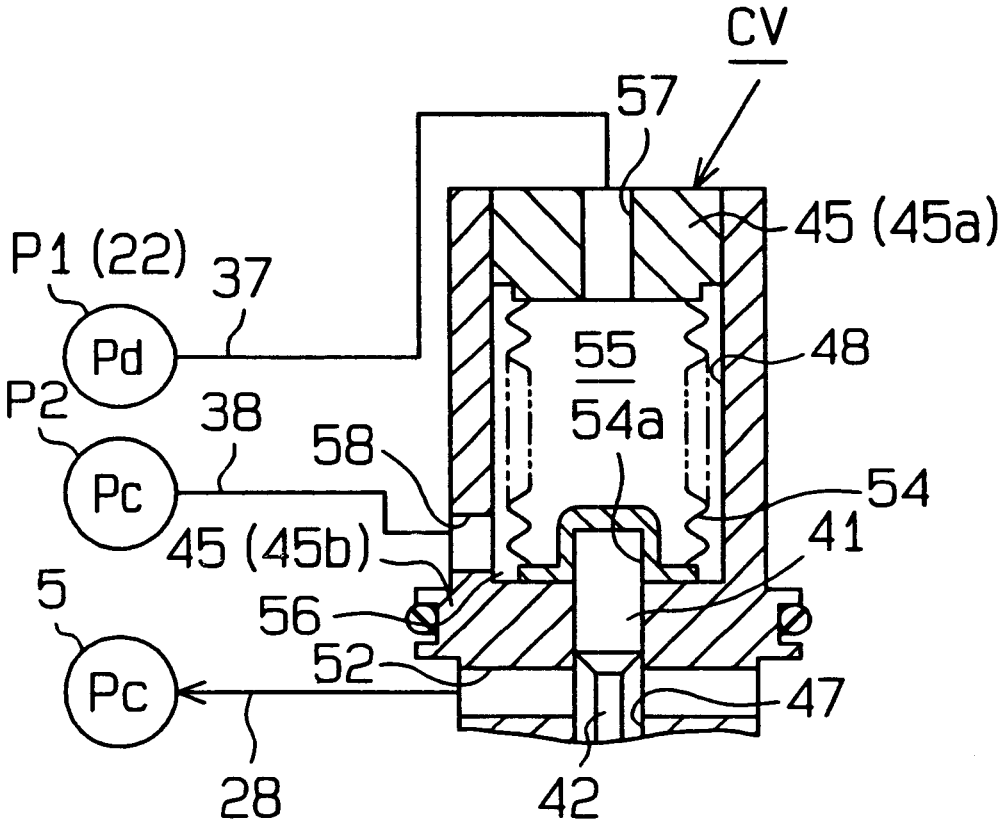
FIG. 7 is an enlarged partial view illustrating a control valve according to a fifth embodiment.

The target value of the pressure difference ΔPd can be externally adjusted by changing the duty ratio, which controls the current value that is supplied to the coil 67 of the control valve CV. Therefore, compared with a control valve that has no electromagnetic structure (an external control means) or a control valve that only allows a single target value as shown in FIG. 7, the control valve CV of the present invention responds to the changes in air conditioning demands.

As for the pressure sensing member 54, a spool (or piston) that is capable of sliding in the pressure sensing chamber 48 may be used instead of the bellows in the first embodiment. However, the sliding resistance between the spool and the inner wall of the pressure sensing chamber 48, or a foreign particle caught between the spool and the wall may hinder smooth movement of the spool. When the spool does not move smoothly, the fluctuations of the pressure difference ΔPd are not promptly reflected in the opening size of the valve and the discharge displacement of the compressor. As a result, the cooling performance of an air-conditioning system deteriorates. Accordingly, when a spool is used as the pressure sensing member 54, it is required to perform surface treatment such as smooth grinding and to form a low-friction coating to reduce the sliding resistance between the spool and the inner wall of the pressure sensing chamber 48. Alternatively, a filter must be provided in each pressure detecting passage 37 and 38 to remove foreign particles. As a result, the cost of the control valve CV increases.

However, the pressure sensing member 54 of the first embodiment is formed of the bellows. The bellows is displaced (deformed) without sliding along the inner wall of the pressure sensing chamber 48 according to the fluctuations of the pressure difference ΔPd. Thus, the valve body portion 43 of the operation rod 40 is promptly and accurately displaced according to the fluctuations of the pressure difference ΔPd. Accordingly, there is no need to perform surface treatment to reduce the sliding resistance of a spool or to provide a filter to remove foreign particles. As a result, the cost of the control valve CV is reduced.

The control valve CV changes the pressure in the crank chamber 5 by regulating the supply passage 28. The control valve CV changes the opening size of the supply passage 28. Compared with a control valve that regulates the bleed passage 27, the pressure in the crank chamber 5, that is, the discharge displacement of the compressor, is varied more promptly because the control valve receives high pressure. This improves the cooling performance of the air-conditioner.

The first and second pressure monitoring points P1, P2 are provided between the discharge chamber 22 and the condenser 31 of the compressor. Therefore, the pressure monitoring points P1, P2 are not affected by the expansion valve 32. Thus, the control valve reliably controls the discharge displacement of the compressor in accordance with the pressure difference ΔPd.

The present invention may be modified as follows.

Figure 3:
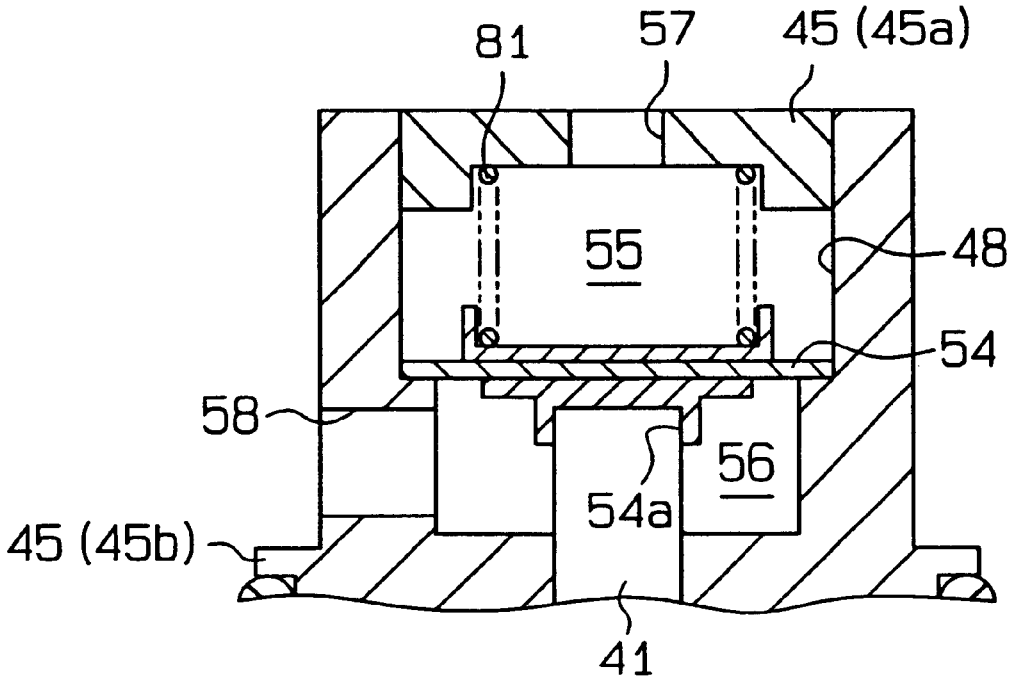
FIG. 3 is an enlarged partial cross-sectional view illustrating a control valve according to a second embodiment.

According to a second embodiment as shown in FIG. 3, a diaphragm may be used as the pressure sensing member 54. In the second embodiment, the pressure sensing member 54 and a separate spring 81, which function as the pressure sensing member 54 in FIG. 2, are located between the cap 45*a* and the pressure sensing member 54.

Figure 4:
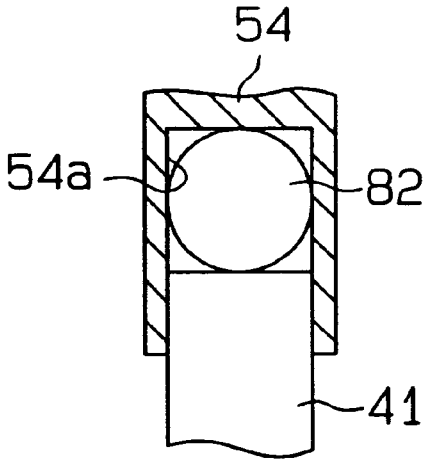
FIG. 4 is an enlarged partial view illustrating a control valve according to a third embodiment.

According to a third embodiment shown in FIG. 4, a ball 82 may be provided in the accommodating portion 54*a* of the pressure sensing member 54. In this case, the pressure sensing member 54 and the valve body portion 43 of the operation rod 40 contact each other through the ball 82. Even when the pressure sensing member 54 is tilted with respect to the axial direction of the operation rod 40, the ball 82 aligns the load to be transmitted in the axial direction of the operation rod 40 from the pressure sensing member 54 to the operation rod 40. Thus, the invention prevents the opening size of the control valve CV from being different from the desired value due to tilting of the valve body portion 43 of the operation rod 40.

Figure 5:
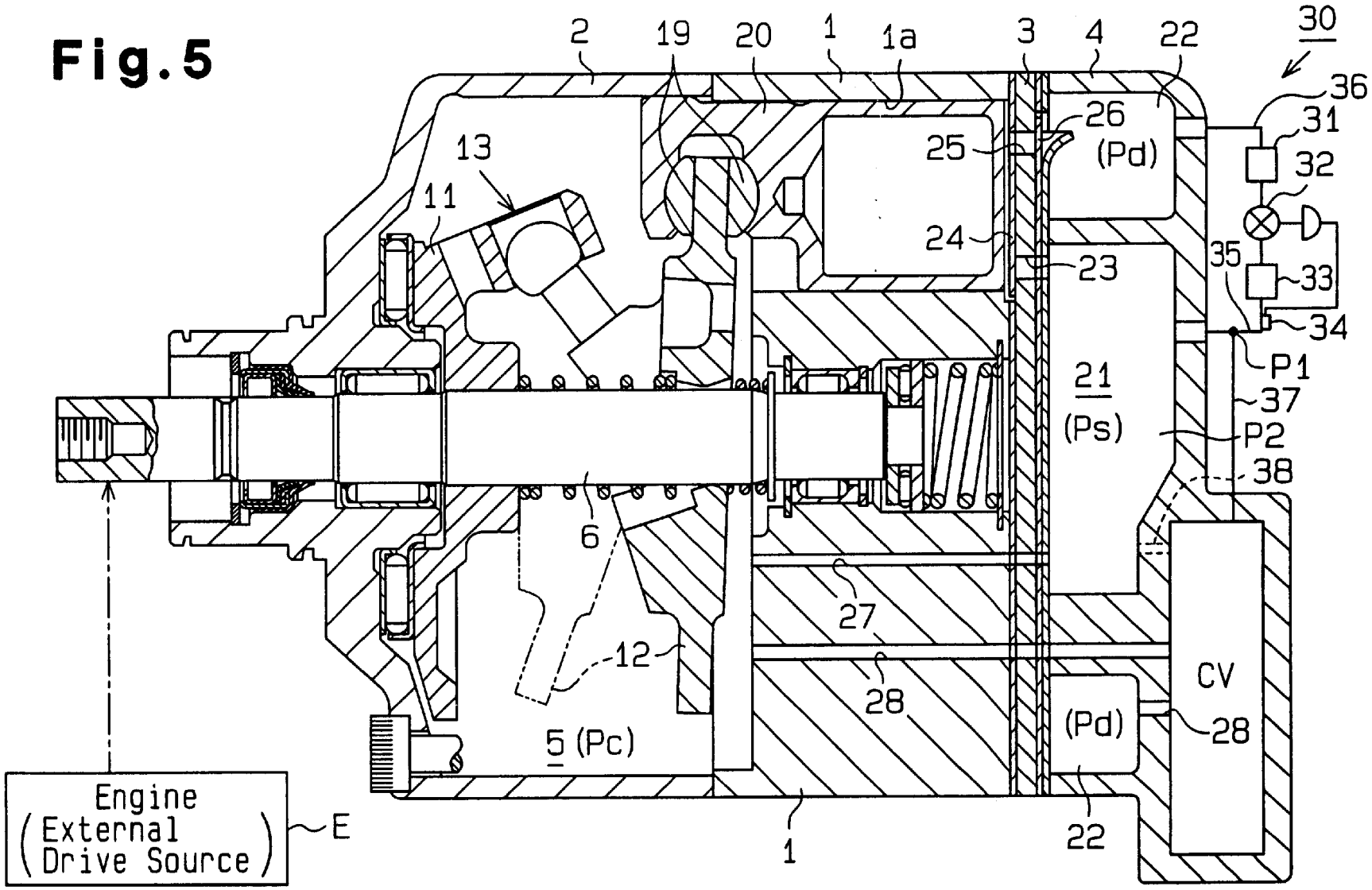
FIG. 5 is a cross-sectional view illustrating a compressor according to a fourth embodiment, which has two pressure monitoring points at different positions from FIG.
Figure 6:
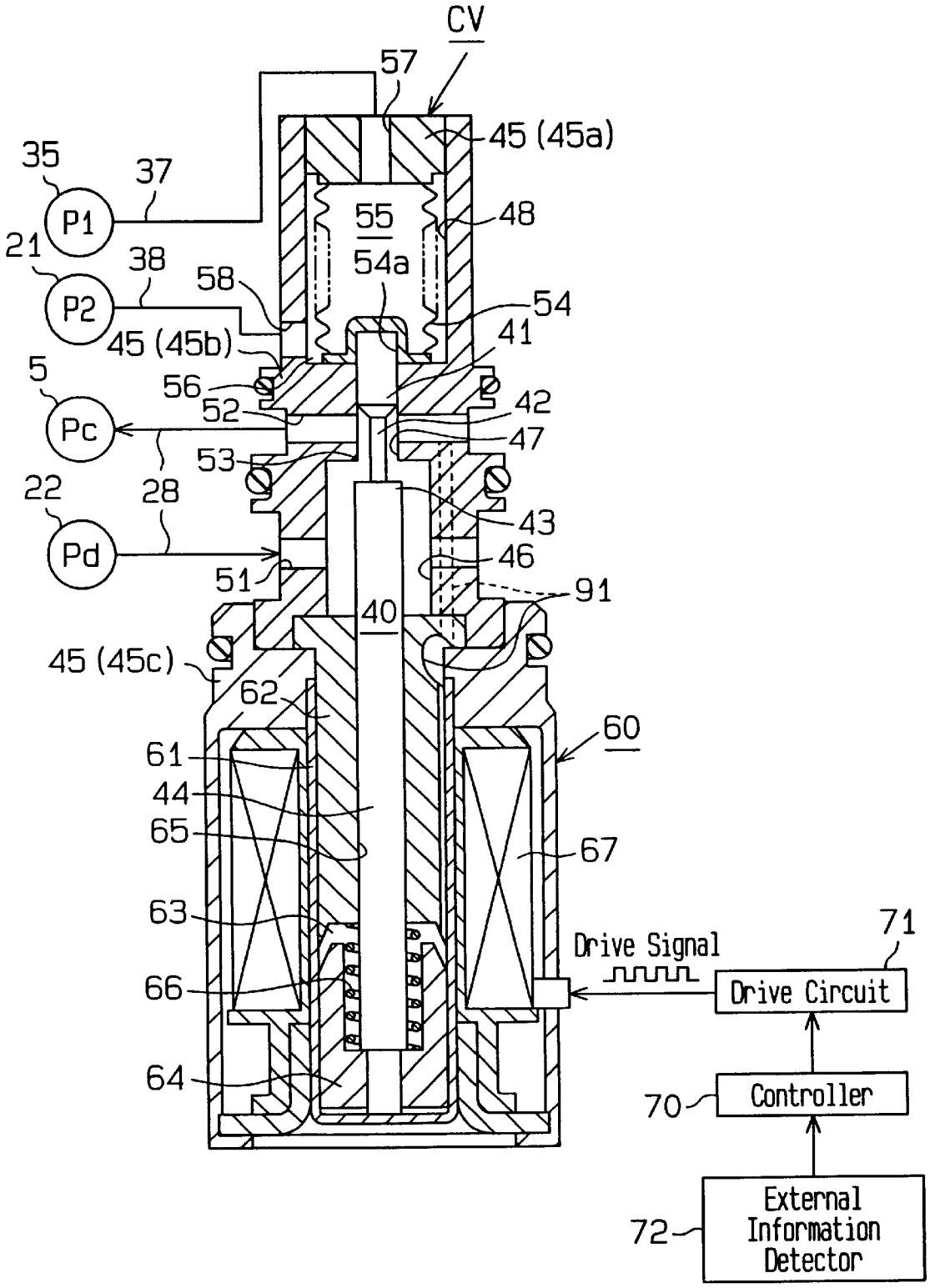
FIG. 6 is a cross-sectional view of the control valve provided in the compressor of FIG. 5.

According to a fourth embodiment as shown in FIGS. 5 and 6, the first pressure monitoring point P1 may be located in the suction pressure zone (in the connecting pipe 35 in FIG. 5) between the evaporator 33 and the suction chamber 21. The second pressure monitoring point P2 may be located downstream of the first pressure monitoring point P1 (in the suction chamber 21 in FIG. 5).

In the fourth embodiment, the pressure difference between the communication passage 47, which is exposed to the crank pressure Pc, and the second pressure chamber 56, which is exposed to the suction pressure Ps, is decreased. As a result, gas leakage between the communication passage 47 and the pressure chamber 56 is minimized. Thus, the control valve accurately controls the discharge displacement.

The port 52 and the solenoid chamber 63 are connected through a pressure passage 91, which is located in the valve housing 45. Therefore, the crank pressure Pc in the communication passage 47 is applied to the solenoid chamber 63. Unlike a control valve in which the discharge pressure Pd is applied to the solenoid chamber 63, applying the relatively low crank pressure Pc to the solenoid chamber 63 prevents the high discharge pressure Pd from adversely affecting the positioning of the operation rod 40.

For example, the solenoid chamber 63 may be connected with the first pressure chamber 55 or the second pressure chamber 56 through the supply passage such that the pressure in the suction pressure zone is applied to the solenoid chamber 63.

The first pressure monitoring point P1 may be located in the discharge pressure zone between the discharge chamber 22 and the condenser 31. For example, the first pressure monitoring point P1 may be located in the discharge chamber 22. The second pressure monitoring point P2 may be located in the suction pressure zone between the evaporator 33 and the suction chamber 21. For example, the second pressure monitoring point P2 may be located in the suction chamber 21.

In the fifth embodiment as shown in FIG. 7, the first pressure monitoring point P1 may be located in the discharge pressure zone (the discharge chamber 22 in FIG. 7), which includes the condenser 31 and the discharge chamber 22. The second pressure monitoring point P2 may be located in the crank chamber 5. That is, the second pressure monitoring point P2 need not be located in a refrigerant passage that functions as the main circuit of the refrigerant circuit, which includes the evaporator 33, the suction chamber 21, the cylinder bores 1*a*, the discharge chamber 22 and the condenser 31. In other words, the second pressure monitoring point P2 need not be located in a low pressure zone in the refrigerant circuit. For example, the second pressure monitoring point P2 may be located in the crank chamber 5. The crank chamber 5 is an intermediate pressure zone in a refrigerant passage for controlling the compressor displacement. The passage for controlling the displacement functions as a sub-circuit of the refrigerant circuit and includes the supply passage 28, the crank chamber 5 and the bleed passage 27.

In the fifth embodiment, the pressure difference between the communication passage 47, which is exposed to the crank pressure Pc, and the second pressure chamber 56, which is exposed to the suction pressure Ps, is decreased. As a result, gas leakage between the communication passage 47 and the pressure chamber 56 is minimized. Thus, the control valve accurately controls the discharge displacement.

Figure 8:
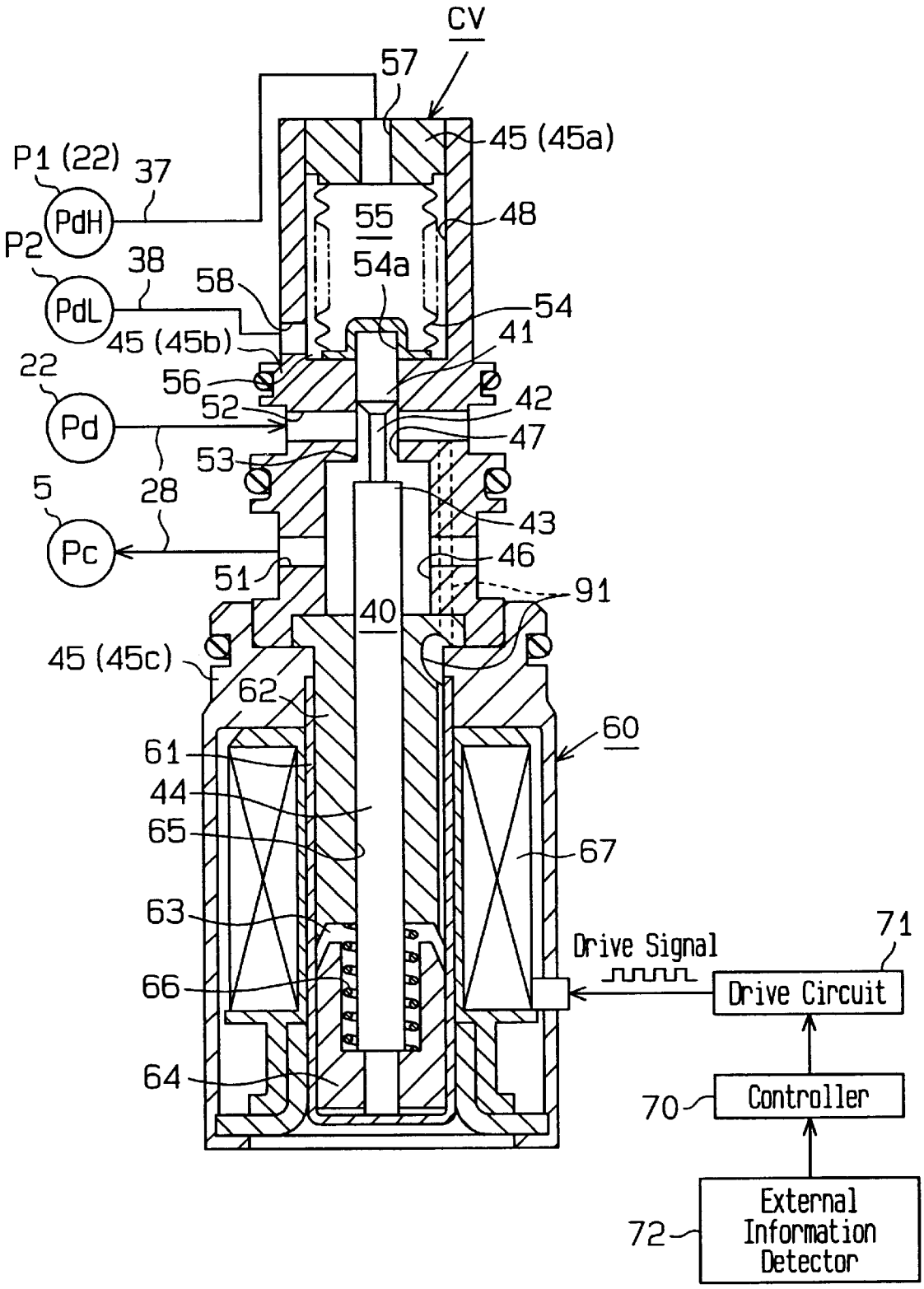
FIG. 8 is a cross-sectional view of a control valve according to a sixth embodiment.

According to a sixth embodiment as shown in FIG. 8, the communication passage 47 may be connected to the discharge chamber 22 through an upstream section of the port 52 and the supply passage 28. The valve chamber 46 may be connected to the crank chamber 5 through a downstream section of the port 51 and the supply passage 28. This reduces the pressure difference between the communication passage 47 and the second pressure chamber 56, and gas leakage between the communication passage 47 and the second pressure chamber 56 is limited. Thus, the control valve accurately controls the discharge displacement.

The clearance between the guide portion 44 of the operation rod 40 and the guide hole 65 is very small. Thus, the valve chamber 46 is substantially disconnected from the solenoid chamber 63. The port 52 and the solenoid chamber 63 are connected through the pressure passage 91, which is located in the valve housing 45. Therefore, the pressure in the communication passage 47, that is, the discharge pressure Pd (PdH), is applied to the solenoid chamber 63. Accordingly, the opening of the control valve CV is reliably controlled as in the embodiment shown in FIG. 2. The discharge pressure Pd that is applied to the solenoid chamber 63 is not limited to PdH. For example, the discharge pressure PdL, which is relatively lower than PdH, may be applied to the solenoid chamber 63 from the second pressure chamber 56.

Figure 9:
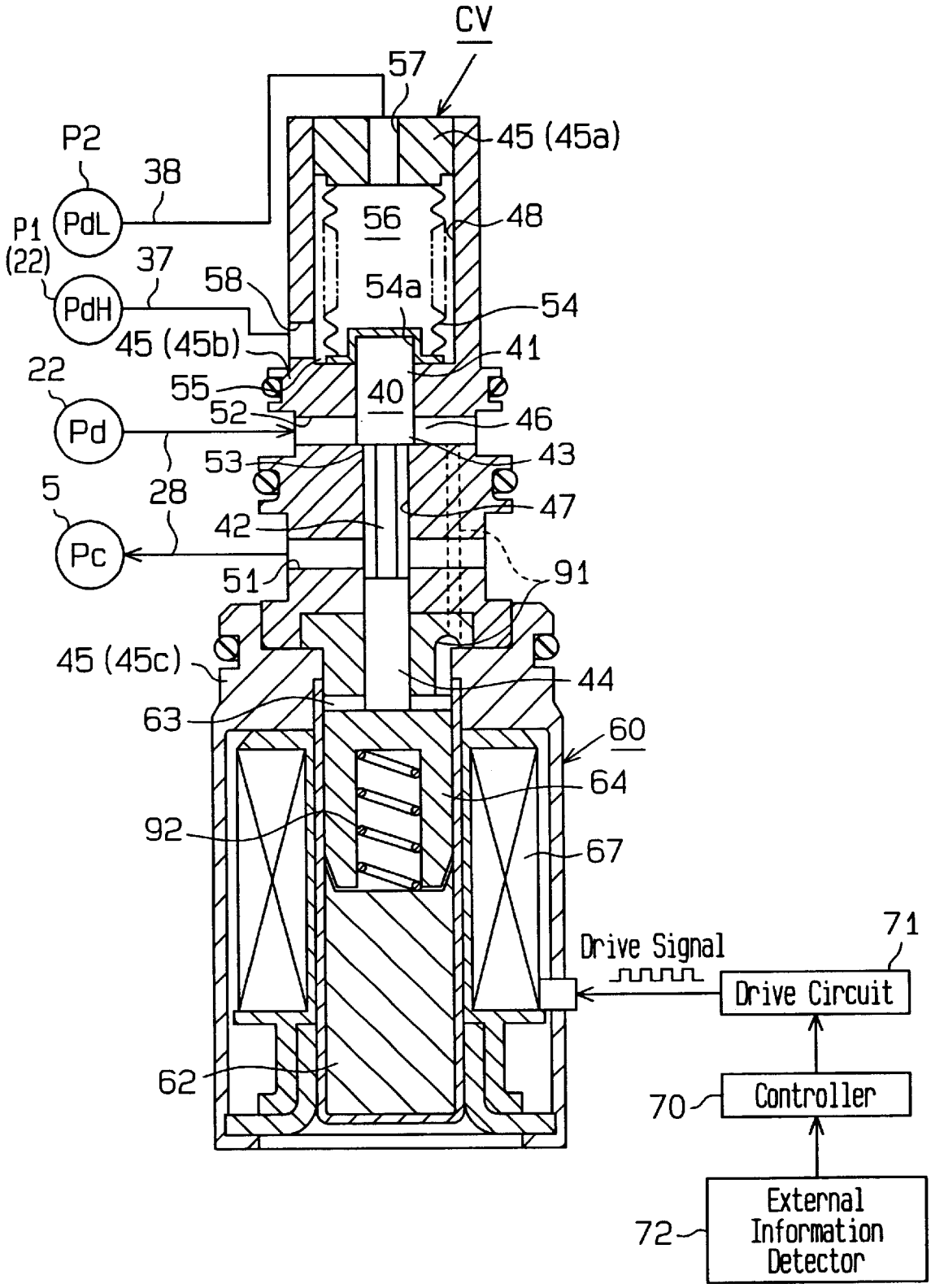
FIG. 9 is a cross-sectional view of a control valve according to a seventh embodiment.
Figure 10:
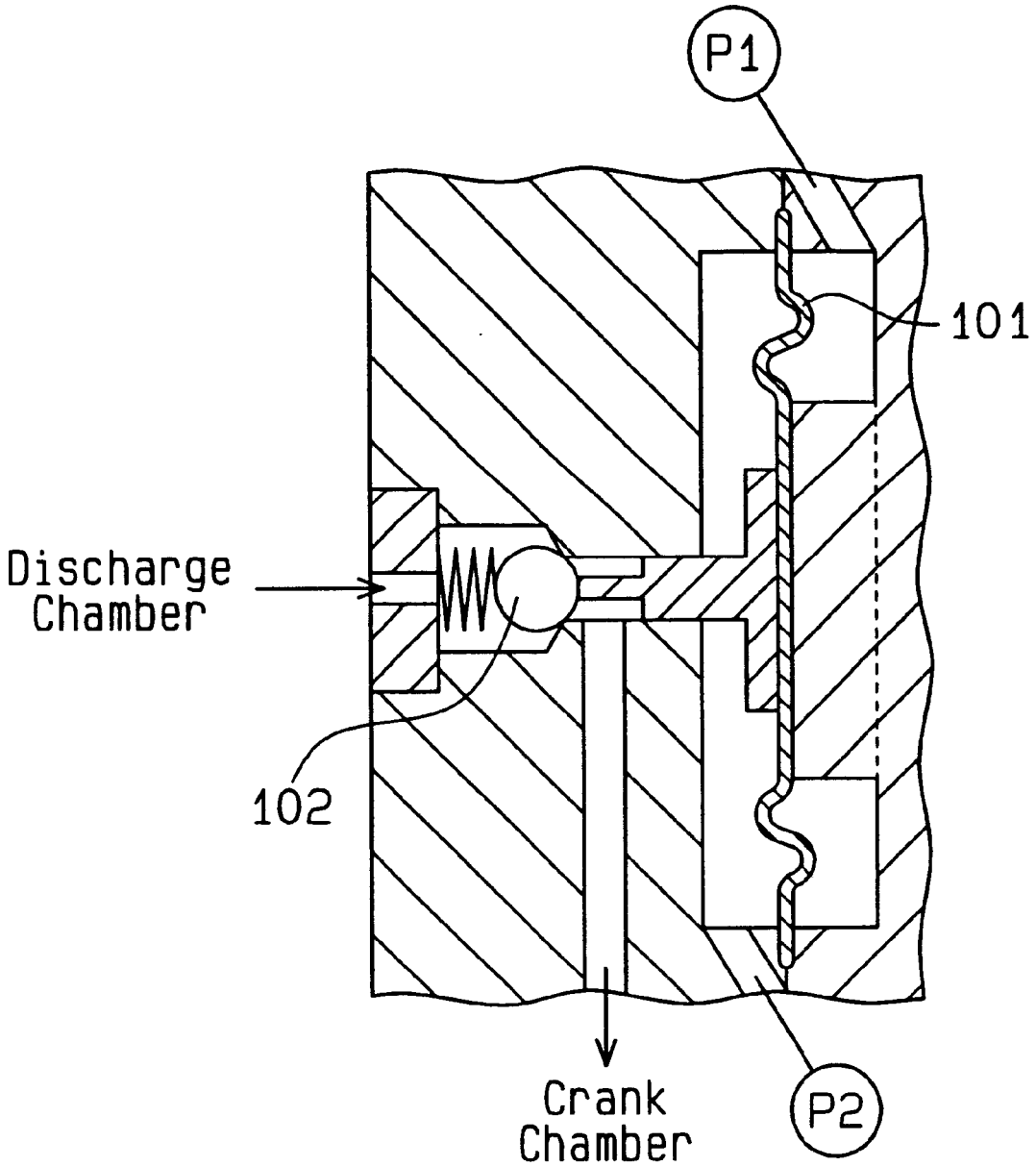
Fig.10(Prior Art)
FIG. 10 is an enlarged partial cross-sectional view illustrating a prior art control valve.

According to a seventh embodiment as shown in FIG. 9, the space in the pressure sensing member 54 may be the second pressure chamber 56, and the space between the inner wall of the pressure sensing chamber 48 and the pressure sensing member 54 may be the first pressure chamber 55. In the control valve CV of the seventh embodiment, the positions of the communication passage 47 and the valve chamber 46 in the valve housing 45 are opposite to that of the control valve CV in FIG. 2. When the valve body portion 43 of the operation rod 40 moves upward, the opening size of the communication passage 47 increases. When the operation rod 40 moves downward, the opening size of the communication passage 47 decreases.

In the control valve CV of the seventh embodiment, the electromagnetic force of the solenoid portion 60 urges the movable iron core 64 downward. A spring 92 is provided between the movable iron core 64 and the fixed iron core 62 in the solenoid chamber 63. The spring 92 urges the movable iron core 64 in the direction opposite to the direction of the electromagnetic force, that is, upward in the Figures.

The port 52 connects the valve chamber 46 to the discharge chamber 22. The solenoid chamber 63 is communicated with the port 52 through the pressure passage 91, which is located in the valve housing 45. Therefore, the discharge pressure Pd (PdH) in the valve chamber 46 is applied to the solenoid chamber 63. Thus, the opening size of the control valve CV is reliably controlled in the embodiment shown in FIG. 9 as in the embodiment shown in FIG. 2. The discharge pressure Pd that is applied to the solenoid chamber 63 is not limited to PdH. For example, the discharge pressure PdL, which is lower than PdH, may be applied to the solenoid chamber 63 from the second pressure chamber 56.

The present invention may be embodied in an air-conditioning system that has a wobble plate type variable discharge compressor.

Therefore, the present examples and embodiments are to be considered as illustrative and not restrictive and the invention is not to be limited to the details given herein, but may be modified within the scope and equivalence of the appended claims.

What is claimed is:

1. A control valve used for a variable displacement compressor installed in a refrigerant circuit of a vehicle air conditioner, wherein the refrigerant circuit has a discharge pressure zone, wherein the compressor varies the displacement in accordance with the pressure in a crank chamber, and the compressor has a supply passage, which connects the crank chamber to the discharge pressure zone, the control valve comprising:

a valve housing;

a valve chamber defined in the valve housing to form a part of the supply passage;

a valve body, which is accommodated in the valve chamber for adjusting the opening size of the supply passage;

a pressure sensing chamber defined in the valve housing;

a pressure sensing member, which separates the pressure sensing chamber into a first pressure chamber and a second pressure chamber, wherein the pressure at a first pressure monitoring point located in the refrigerant circuit is applied to the first pressure chamber, and the pressure at a second pressure monitoring point located in the refrigerant circuit is applied to the second pressure chamber, wherein the pressure sensing member moves the valve body in accordance with the pressure difference between the first pressure chamber and the second pressure chamber such that the displacement of the compressor is varied to counter changes of the pressure difference, and wherein the pressure sensing member is a bellows or a diaphragm; and an actuator for applying force to the pressure sensing member in accordance with external commands, wherein the force applied by the actuator corresponds to a target value of the pressure difference, and wherein the pressure sensing member moves the valve body such that the pressure difference seeks the target value.

2. The control valve according to claim 1, wherein the first pressure monitoring point and the second pressure monitoring point are located in the discharge pressure zone.

3. The control valve according to claim 1, wherein the refrigerant circuit has a suction pressure zone, and wherein the first pressure monitoring point and the second pressure monitoring point are located in the suction pressure zone.

4. The control valve according to claim 1, wherein the refrigerant circuit has a suction pressure zone, wherein the first pressure monitoring point is located in the discharge pressure zone, and the second pressure monitoring point are located in the suction pressure zone or the crank chamber.

5. The control valve according to claim 1, wherein the actuator is a solenoid, which applies force in accordance with a supplied electrical current.

6. The control valve according to claim 1, wherein a ball is located between the pressure sensing member and the valve body.

* * * * *